US006784626B2

(12) United States Patent
Otake et al.

(10) Patent No.: US 6,784,626 B2
(45) Date of Patent: Aug. 31, 2004

(54) ELECTRONIC BALLAST AND LIGHTING FIXTURE

(75) Inventors: Hirokazu Otake, Yokosuka (JP); Koji Takahashi, Yokosuka (JP); Hiroshi Terasaka, Yokosuka (JP); Hideo Kozuka, Yokosuka (JP)

(73) Assignee: Toshiba Lighting & Technology Corporation, Tokyo (JP)

( * ) Notice: Subject to any disclaimer, the term of this patent is extended or adjusted under 35 U.S.C. 154(b) by 0 days.

(21) Appl. No.: 10/455,781

(22) Filed: Jun. 6, 2003

(65) Prior Publication Data

US 2004/0051478 A1 Mar. 18, 2004

(30) Foreign Application Priority Data

Jun. 28, 2002 (JP) ..... 2002-189699
Mar. 31, 2003 (JP) ..... 2003-095642

(51) Int. Cl.[7] ..... H05B 37/02; G05F 1/00

(52) U.S. Cl. ..... 315/291; 315/244; 315/209 R; 315/307

(58) Field of Search ..... 315/291, 244, 315/247, 209 R, 307, 219, 224, DIG. 4; 363/132

(56) References Cited

U.S. PATENT DOCUMENTS 5,500,792 A * 3/1996 Jeon et al. ..... 363/98
5,598,326 A * 1/1997 Liu et al. ..... 363/34
6,057,652 A * 5/2000 Chen et al. ..... 315/307
6,072,710 A * 6/2000 Chang ..... 363/132
6,281,636 B1 * 8/2001 Okutsu et al. ..... 315/209 R
6,696,803 B2 * 2/2004 Tao et al. ..... 315/291

FOREIGN PATENT DOCUMENTS

JP 7-274524 10/1995

* cited by examiner

*Primary Examiner*—Tan Ho
*Assistant Examiner*—Chuc Tran
(74) *Attorney, Agent, or Firm*—Pillsbury Winthrop LLP

(57) ABSTRACT

An electronic ballast comprises a direct current power supply configured to provide a direct current voltage.

A switching circuit, including first and second switching elements, is connected in parallel with the direct current power supply, and is configured to convert the direct current voltage to a high-frequency alternating current.

A load circuit, including a discharge lamp, a resonance inductor, and a resonance capacitor, is operated by the high-frequency alternating current. A driving circuit is arranged between the switching circuit and the load circuit.

A driving circuit is provided with feedback windings magnetically connected to a detecting winding of the current transformer. A driving circuit is configured to control a switching frequency of the first and second switching elements according to a detected current of the detecting winding.

A magnetic energy control means is configured to control a magnetic energy of the current transformer.

A current detecting means detects an average current either an output current of the direct current power supply or a current of the switching circuit.

A current control means is configured to control the magnetic energy control means, and to fix the average current to a designated value.

3 Claims, 3 Drawing Sheets

ELECTRONIC BALLAST AND LIGHTING FIXTURE

BACKGROUND OF THE INVENTION

1. Field of the Invention

The present invention relates to an electronic ballast and a lighting fixture using the electronic ballast.

2. Description of Related Art

Generally, an electronic ballast for a discharge lamp comprises a half-bridge inverter, a current transformer, and a load circuit including a discharge lamp. The current transformer includes a detecting winding and a feedback winding. The feedback winding generates a driving signal of switching elements of the half-bridge inverter. Since a core of the current transformer is made of magnetic material, characteristics of the current transformer intends to change according to a heat thereof. Therefore, a current value of the feedback winding changes, so that a switching frequency of the switching elements changes. As a result, an output of the inverter changes, and a lighting output of the discharge lamp changes.

Such an electronic ballast, shown in FIG. 5, is known in Japanese Laid Open Patent Application HEI07-274524 (the '524 application). The electronic ballast comprises an alternating current power supply (E), a full-wave rectifier 21, a smoothing capacitor C11, an inverter circuit 22 including a current transformer Tr11, and a load circuit including fluorescent lamps FL1, FL2. A first winding Tr12*a* of the electrical insulating transformer Tr12 is also connected to the current transformer Tr11*a*. Furthermore, a current detecting circuit 24, arranged between the first winding Tr12*a* and a capacitor C12, detects a current of the first winding Tr12*a* corresponding to a current of the fluorescent lamps FL1 and FL2. The current detecting circuit 24 supplies its output current to a base of a transistor Q13 of a current control means 26. The current detecting circuit 24 can control a base current of the transistor Q13. Therefore, the base current of the transistor Q13 changes, so that an impedance of a control winding Tr11*d* of the current transformer changes to be fix to a designated current of the fluorescent lamps FL1 and FL2.

According to the '524 application, the current detecting means 24 is only detecting the current of the first winding Tr12*a* in order to fix the current of the fluorescent lamps FL1 and FL2. The current detecting means 24 can not detect a current of the capacitor C12. Therefore, when the current of the current transformer Tr11 changes due to a heat of the current transformer Tr11, the current detecting means 24 can not properly detect the current of the current transformer Tr11.

Furthermore, another electronic ballast is known in Japanese Patent Registration 3,164,134 (the '134 patent), in order to avoid a magnetic characteristic change of the current transformer. Such an electronic ballast 50, shown in FIG. 6, comprises an inverter circuit 54 including switching elements Q3, Q4, a current transformer CT4, a magnetic energy control means including a voltage double rectifier circuit 51 and an output controlling circuit 52, and a load circuit 55. A variable resistor of the magnetic energy control means is replaced to an element 53 of a temperature changeable type.

Since a resistance of the element 53 changes due to a heat, a consumption of electricity of the output controlling circuit 52 changes. Therefore, a magnetic energy of the current transformer CT4 changes, so that a saturation interval of the current transformer CT4 also changes. As a result, the switching frequency of the switching elements Q3, Q4 changes to be fix the output of the inverter circuit 54. In case of the '134 patent, since the resistance of the element 53 changes slowly, the inverter 54 can not quickly response to output.

Furthermore, it is desired that common electronic ballast can operate each different discharge lamp having different lamp characteristics. Generally, the electronic ballast is designed to obtain suitable output of the discharge lamp. In order to design the electronic ballast for one discharge lamp so as to adapt to even the other discharge lamp, the electronic ballast must be designed to generate a rated light output of each discharge lamp. That is, it is advantageous for the electronic ballast to control its output power.

SUMMARY OF THE INVENTION

According to one aspect of the invention, an electronic ballast comprises a direct current power supply configured to provide a direct current voltage. A switching circuit, including first and second switching elements, is connected in parallel with the direct current power supply, and is configured to convert the direct current voltage to a high-frequency alternating current. A load circuit, including a discharge lamp, a resonance inductor, and a resonance capacitor, is operated by the high-frequency alternating current. A driving circuit is arranged between the switching circuit and the load circuit. A driving circuit is provided with feedback windings magnetically connected to a detecting winding of the current transformer. A driving circuit is configured to control a switching frequency of the first and second switching elements according to a detected current of the detecting winding. A magnetic energy control means is configured to control a magnetic energy of the current transformer. A current detecting means detects an average current either an output current of the direct current power supply or a current of the switching circuit. A current control means is configured to control the magnetic energy control means, and to fix the average current to a designated value.

According to another aspect of the invention, an electronic ballast comprises a direct current power supply configured to provide a fixed direct current voltage. A switching circuit, including first and second switching elements, is connected in parallel with the direct current power supply, and is configured to convert the direct current voltage to a high-frequency alternating current. A load circuit, including a discharge lamp, a resonance inductor, and a resonance capacitor, is operated by the high-frequency alternating current. A driving circuit is provided with a detecting winding of a current transformer, and is configured to control a switching frequency of the first and second switching elements according to a detected current of the detecting winding. A magnetic energy control means, including a base of a transistor, is configured to control a magnetic energy of the current transformer. A current detecting means detects an average current either an output current of the direct current power supply or a current of the switching circuit. A current control means is configured to control the magnetic energy control means and to fix the average current to a designated value. A current control means is provided with a comparator, wherein the comparator compares a voltage signal of the average current with a reference voltage, and its output supplies to a base current of the base of the transistor.

According to another aspect of the invention, a lighting fixture comprises a body; lamp sockets, and an electronic ballast.

These and other aspects of the invention will be further described in the following drawings and detailed description of the invention.

BRIEF DESCRIPTION OF THE DRAWINGS

The invention will be described in more detail below by way of examples illustrated by drawings in which.

DETAILED DESCRIPTION OF A PREFERRED EMBODIMENT OF THE INVENTION

A first embodiment of the present invention will be described in detail with reference to FIG. 1.

Figure 1:
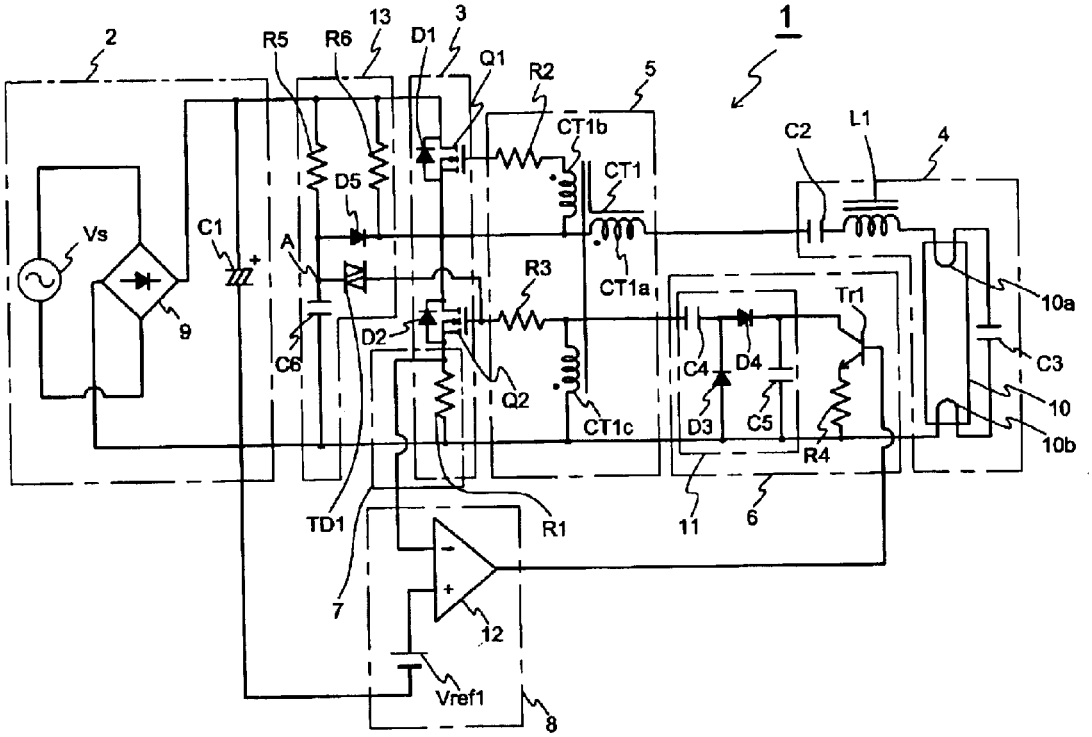
FIG. 1 is a circuit diagram of an electronic ballast according to a first embodiment of the present invention.

FIG. 1 shows a circuit diagram of an electronic ballast according to a first embodiment of the present invention. The electronic ballast for a discharge lamp 1 comprises an alternating current power supply (Vs), a direct current power supply 2, a switching circuit 3, a load circuit 4, a driving circuit 5, a magnetic energy control means 6, a current detecting means 7, and a current control means 8.

The direct current power supply 2 is provided with a smoothing capacitor C1, connected in parallel with a full-wave rectifier 9, and the alternating current power supply (Vs) of 100V to 200V on commercial power supply. Therefore, the smoothing capacitor C1 generates a direct current voltage at both ends thereof. The direct current power supply may use a battery, or a chopper circuit to fix its output voltage.

The switching circuit 3 or half-bridge inverter circuit comprises a series circuit of a resistor R1 and first and second switching elements Q1, Q2, connected in parallel with the smoothing capacitor C1. Each of the first and second switching elements Q1, Q2 is a field-effect transistor. A drain of the switching element Q1 is connected to a positive side of the smoothing capacitor C1. A source of the switching element Q2 is connected to a negative side of the smoothing capacitor C1. Each of the first and second switching elements Q1, Q2 includes a diode D1, D2 therein.

The load circuit 4 is provided with a series circuit including a capacitor C2 for cutting a direct current, a resonance inductor L1, a discharge lamp 10, and a resonance capacitor C3. Furthermore, the load circuit 4 is connected with the second switching element Q2 in parallel, through the resistor R1 and a current transformer CT1. An electrostatic capacity for resonance is made from a capacity of the resonance capacitor C3. The electrostatic capacity of the capacitor C2 is bigger than that of the resonance capacitor C3.

The discharge lamp 10 may be a fluorescent lamp having a pair of filament electrodes 10*a*, 10*b*. The inductor L1 also has an operation of controlling a current to flow into the fluorescent lamp 10. The fluorescent lamp 10 is started by a high frequency alternating current or power generated by the switching circuit 3.

The driving circuit 5, arranged between the switching circuit 3 and the load circuit 4, comprises feedback windings CT1*b* and CT1*c* magnetically connected to a detecting winding CT1*a* of the current transformer CT1. The current transformer CT1 has a magnetic characteristic changed by environmental temperature or heat of itself. The detecting winding CT1*a* detects a current flowing to the load circuit 4. The feedback winding CT1*b* is connected between a gate and the source of the switching element Q1 via a resistor R2. Furthermore, the other feedback winding CT1*c* is connected between a gate and the source of the second switching element Q2 via a resistor R3. Each of the feedback windings CT1*c*, CT1*b* generates a feedback current generated by the current of the detecting winding CT1*a*. Each feedback current generates a voltage at both ends of the resistors R2 and R3 respectively. When the voltage rises higher than a threshold voltage of each of the first and second switching elements Q1, Q2, each of the first and second switching elements Q1, Q2 is turned on.

Furthermore, the feedback windings CT1*c*, CT1*b* operates to become opposite polarity. That is, the feedback winding CT1*b* lets the first switching element Q1 turn on, when a current flows to the load circuit 4 via the detecting winding CT1 a from the first switching circuit 3.

Next, the feedback winding CT1*c* lets the second switching element Q2 turn on, when a current flows to the switching circuit 3 from the load circuit via the detecting winding CT1*a*. Therefore, the driving circuit 5 can control switching of the first and second switching elements Q2, Q3.

The magnetic energy control means 6 is provided with a voltage double rectifier circuit 11 and a series circuit, which is connected with the voltage double rectifier circuit 11 in parallel, including a bi-polar transistor Tr1 and a resistor R4. The magnetic energy control means 6 is also connected with the feedback winding CT1*c* in parallel.

The voltage double rectifier circuit 11 comprises a series circuit, including a capacitor C4 and a diode D3, connected with in parallel the feedback winding CT1*c*. The voltage double rectifier circuit 11 comprises a series circuit, including a diode D4 and a capacitor C5, connected with the feedback winding CT1*c* in parallel. The capacitor C5 is connected to a series circuit including the bi-polar transistor Tr1 and a resistor R4 in parallel. The voltage double rectifier circuit 11 rectifies a driving current of the switching means Q1, Q2, and charges its output voltage to the capacitor C5. The charged electricity of the capacitor C5 can be discharged by the bi-polar transistor Tr1. While the capacitor C5 discharges its electricity, the current transformer CT1 can not saturate, and can delay its saturation interval.

The magnetic energy control means 6 reduces a magnetic energy of the feedback winding CT1*c*, when a base current of the bi-polar transistor Tr1 increases. Accordingly, the magnetic energy control means 6 can delay saturation interval. When the saturation interval delays, it takes more time for the voltage of the resistor R2, R3 to increase to the threshold voltage of the first and second switching elements Q1, Q2. Therefore, the switching frequency of the first and second switching elements Q1, Q2 decreases. When the base current of the bi-polar transistor Tr1 decreases, the magnetic energy control means 6 can increase the magnetic energy of the feedback winding CT1*c*.

Accordingly, the magnetic energy control means 6 can advance the saturation interval. When the saturation interval advances, it takes short time for the voltage of the resistor R2, R3 to increase to the threshold voltage of the first and second switching elements Q1, Q2. Therefore, the switching frequency of the first and second switching elements Q1, Q2 increases. Accordingly, the magnetic energy control means 6 can change the switching frequency of the first and second switching elements Q1, Q2.

The current detecting means 7 is provided with the switching circuit 3 including a resistor R1, and detects an average current of the resistor 3 as a voltage signal. A drain current between the drain and the source of the switching element Q2 flows through the resistor R1. Furthermore, a resonance current, generated by the resonance inductor L1 and capacitor C2, flows through the resistor R1 via the diode D2. The drain current and the resonance current are changed to the average current. And the voltage signal of the average current is input to the current control means 8.

The current control means 8 includes a comparator 12. The comparator 12 inputs the voltage signal of the average current to its inversion inputting terminal. The comparator 12 also inputs a reference voltage Vref1 to its other inputting terminal in order to compare the voltage signal of the average current and the reference voltage Vref1. The reference voltage means a designated voltage to fix the voltage signal of the average current to the designated voltage. An outputting terminal of the comparator 12 is connected to a base of the bi-polar transistor Tr1. And an output current of the comparator 12 is supplied to the base current of the bi-polar transistor Tr1. After the comparator 12 compares the voltage signal of the average current and the reference voltage Vref1, when the voltage signal of the average current is higher than the reference voltage value, the comparator 12 reduces the base current supplied to the base of the bi-polar transistor Tr1 of the magnetic energy control means 6. As a result, the switching frequency of the first and second switching elements Q1, Q2 increases. Therefore, the average current of the drain current and the resonance current reduces and becomes to the designated voltage. The other way, when the voltage signal of the average current is lower than the reference voltage, the comparator 12 increases the base current of the bi-polar transistor Tr1. As a result, the switching frequency of the first and second switching elements Q1, Q2 increases. Therefore, the average current of the drain current and the resonance current increases and becomes to the designated voltage.

A starting circuit 13 is arranged between the direct power supply 2 and the switching circuit 3. The starting circuit 13 comprises a serial circuit including a resister R5 and a capacitor C6, a trigger diode TD1, a diode D5, and a resister R6. The trigger diode TD1 is connected between the gate of the switching element Q2 and a connection A of the resister R5 and the capacitor C6. The diode D5 also is connected between the source of the switching element Q1 and the connection (A) of the resister R5 and the capacitor C6. The resister R6 is connected between the gate and the source of the switching element Q1. When the direct power supply 2 is turned on, the capacitor C6 is charged, so that an electrical potential of the connection (A) elevates. When the electrical potential of the connection (A) becomes more a break over voltage of the trigger diode TD1, the trigger diode TD1 conducts. After a voltage of the capacitor C6 is supplied between the gate and source of the second switching element Q2, the second switching element Q2 is turned on. Moreover, the resistor R6 flows a starting current to the second switching element Q2. When the second switching element Q2 is turned on, an electrical charge of the capacitor C6 discharges through a path including the diode D5, the second switching element Q2, the resistor R1 and the negative side of the direct power supply 2. As a result, the trigger diode TD1 becomes in-conductive.

Operation of the above-mentioned electronic ballast will be explained hereinafter. The alternating current power supply (Vs) is turned on, a direct current voltage, smoothed by the direct power supply 2, generates between both ends of the smoothing capacitor C1. The direct current voltage is supplied to the both ends of the switching circuit 3. A direct current of the direct power supply 2 flows from the positive side to negative side through a path including the resister 6, the detecting winding CT1*a* of the current transformer CT1, the capacitor C2 of the load circuit 4, the resonance inductor L1, the filament electrode 10*a* of the fluorescent lamp 10, the resonance capacitor C3, the filament electrode 10*b* of the fluorescent lamp 10. Since the above direct current flows, a magnetic energy stores in the resonance inductor L1. And an electrical charge stores in the resonance capacitor C3.

Furthermore, when the direct power supply 2 is turned on, the capacitor C6 charges so that an electrical potential of the connection (A) elevates. When the electrical potential of the connection (A) becomes more a break over voltage of the trigger diode TD1, the trigger diode TD1 conducts. After a voltage of the capacitor C6 is supplied between the gate and source of the second switching element Q2, the second switching element Q2 is turned on. When the second switching element Q2 is turned on, the electrical charge immediately discharges through the diode D5. As a result, both of the trigger diode TD1 and the second switching element Q2 turns off. When the second switching element Q2 operates to turn on and off, a resonance current, generated by the resonance inductor L1 and resonance capacitor C2, flows to the detecting winding CT1*a* of the current transformer CT1.

The resonance current alternately returns to the positive feedback winding CT1*b*, or CT1*c*. Each of the resonance currents of the positive feedback windings CT1*b*, CT1*c* generates a gate voltage of the first and second switching elements Q1, Q2. Accordingly, the first and second switching elements Q1, Q2 alternately operates to turn on and off. Therefore, a resonance voltage, generated by the resonance inductor L1 and resonance capacitor C2, is supplied between the both filaments 10*a*, 10*b* of the fluorescent lamp 10, so that the fluorescent lamp 10 is lighting. During the fluorescent lamp operation, a temperature of the current transformer CT1 becomes high, because of the current flowing of the current transformer CT1, or generating heat of the lamp 10 or parts of the circuit.

The voltage double rectifier circuit 11 rectifies the resonance current of the positive feedback winding CT1*c*, CT1*c*. An output voltage of the voltage double rectifier circuit 11 charges capacitor 5. An electrical charge of the capacitor 5 flows to a series circuit including the bi-polar transistor Tr1 and resistor R4.

Furthermore, an average current of the second switching element Q2 is detected by the resistor R1. After the average current is changed to a voltage signal, the voltage signal is inputted to the inversion inputting terminal of the comparator 12 of the current control means 8.

After the comparator 12 compares the average current and the reference voltage Vref1, when the average current value is higher than the reference voltage value, the comparator 12 reduces the base current supplied to the base of the bi-polar transistor Tr1 of the magnetic energy control means 6. As a result, the capacitor 5 of the voltage double rectifier circuit 11 reduces a consumption of electricity, so that the magnetic energy of the current transformer CT1, including the positive feedback winding CT1*b*, CT1*c*, and the detecting winding CT1*a*, reduces. The current transformer CT1 makes rapid the saturation interval. The switching frequency of the first and second switching elements Q1, Q2 elevates. Therefore, the average current of the drain current and the resonance current reduces and becomes to the reference voltage Vref1. That is, the average current of the second switching element Q2 is fixed. The other way, when the average current value is lower than the reference voltage value, the comparator 12 increases the base current of the bi-polar transistor Tr1. As a result, the capacitor 5 of the voltage double rectifier circuit 11 increases a consumption of electricity, so that the magnetic energy of the current transformer CT1, including the positive feedback winding CT1*b*, CT1*c*, and the detecting winding CT1*a*, increases. The current transformer CT1 delays the saturation interval. The switching frequency of the first and second switching elements Q1, Q2 drops. Therefore, the average current of the drain current and the resonance current increases and becomes to the reference voltage Vref1.

That is, the average current of the second switching element Q2 is fixed. Furthermore, since the output voltage of the direct current power supply 2 is fixed to a designated voltage, a consumption of electricity of the road circuit 4 fixes. Accordingly, even though characteristics of the current transformer CT1 change caused by a temperature, the consumption of electricity of the road circuit 4 can fix. Therefore, the fluorescent lamp 10 can light stable. Furthermore, even though the electronic ballast is adopted to another fluorescent lamp having different characteristics, another fluorescent lamp can light at rated light output.

Figure 2:
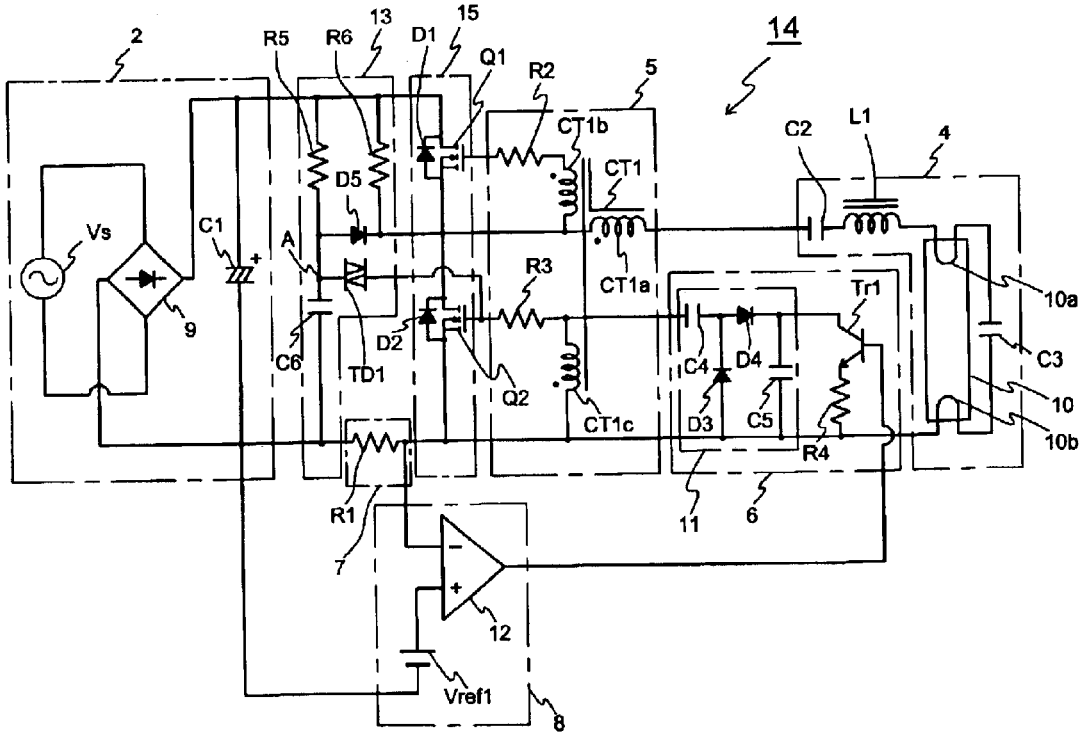
FIG. 2 is a circuit diagram of an electronic ballast according to a second embodiment of the present invention.

A second embodiment of the present invention will be described in detail with reference to FIG. 2. FIG. 2 is a circuit diagram of an electronic ballast according to a second embodiment of the present invention. In this embodiment, a current detecting means 7 is arranged to a different position in a circuit of an electronic ballast in comparison with the circuit of the first embodiment. Similar reference characters designate identical or corresponding elements of the first embodiment. Therefore, detail explanations of the structure will not be provided.

The electronic ballast for a discharge lamp 14 comprises a direct current power supply 2 and a switching circuit 15 including first and second switching elements Q1, Q2. The current detecting means 7 is arranged and connected between a negative side of the direct current power supply 2 and the switching circuit 15.

The current detecting means 7 detects an output average current of the direct current power supply 2 with using a resistor R1, and inputs the average current to an inversion inputting terminal of a comparator 12 of a current control means 8.

The comparator 12 also inputs a reference voltage Vref1 to its other inputting terminal in order to compare the average current and the reference voltage Vref1. The reference voltage means a designated voltage to fix the average current to the designated voltage. An outputting terminal of the comparator 12 is connected to a base of the bi-polar transistor Tr1. And an output current of the comparator 12 is supplied to the base current of the bi-polar transistor Tr1. After the comparator 12 compares the average current and the reference voltage Vref1, when the average current value is higher than the reference voltage value, the comparator 12 reduces the base current supplied to the base of the bi-polar transistor Tr1 of a magnetic energy control means 6. As a result, a switching frequency of the first and second switching elements Q1, Q2 increases.

Therefore, the average current reduces and becomes to the designated voltage. The other way, when the average current value is lower than the reference voltage value, the comparator 12 increases the base current of the bi-polar transistor Tr1. As a result, the switching frequency of the first and second switching elements Q1, Q2 increases. Therefore, the average current increases and becomes to the designated voltage.

That is, the average current of the direct current power supply 2 is fixed to the designated voltage so that, a consumption of electricity of the road circuit 4 fixes. Accordingly, even though characteristics of the current transformer CT1 change caused by a temperature, the consumption of electricity of the road circuit 4 can fix. Therefore, the fluorescent lamp 10 can light stable.

Figure 3:
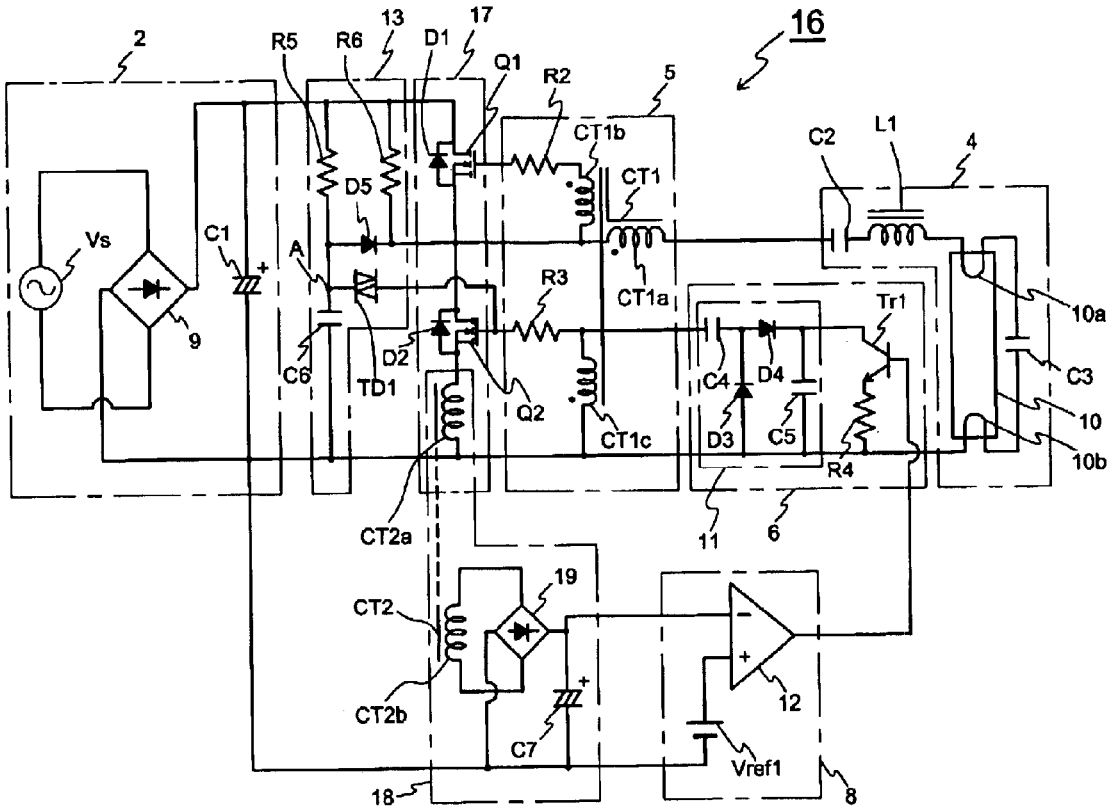
FIG. 3 is a circuit diagram of an electronic ballast according to a third embodiment of the present invention.

A third embodiment of the present invention will be described in detail with reference to FIG. 3. FIG. 3 is a circuit diagram of an electronic ballast according to a third embodiment of the present invention. In this embodiment, the resistor R1 of the first embodiment is replaced with a first winding CT2*a* of a current transformer CT1. Similar reference characters designate identical or corresponding elements of the first embodiment. Therefore, detail explanations of the structure will not be provided.

The electronic ballast for a discharge lamp 16 comprises a direct current power supply 2 and a switching circuit 17 including first and second switching elements Q1, Q2 and a first winding CT2*a* of a current transformer CT1.

A current detecting means 18 comprises the current transformer CT1, a rectifying circuit 19, and a smoothing capacitor C7. An inputting terminal of the rectifying circuit 19 is connected between both terminals of a second winding of the current transformer CT2. The smoothing capacitor C7 is connected between both outputting terminals of the rectifying circuit 19.

The current detecting means 18 detects an average current flowing the first winding CT2*a* of the current transformer CT2. A drain current between a drain and a source of a second switching element Q2 flows through the first winding CT2*a*. Furthermore, a resonance current, generated by a resonance inductor L1 and a capacitor C2, flows through the first winding CT2*a* via a diode D2. The smoothing capacitor C7 changes the drain current and the resonance current to an average voltage. And the average voltage is input to a current control means 8.

The current control means 8 includes a comparator 12. The comparator 12 inputs the average voltage to its inversion inputting terminal. The comparator 12 also inputs a reference voltage Vref1 to its other inputting terminal in order to compare the average voltage and the reference voltage Vref1. The reference voltage means a designated voltage to fix the average voltage to the designated voltage. An outputting terminal of the comparator 12 is connected to a base of the bi-polar transistor Tr1. And an output current of the comparator 12 is supplied to the base current of the bi-polar transistor Tr1. After the comparator 12 compares the average voltage and the reference voltage, when the average voltage value is higher than the reference voltage value, the comparator 12 reduces a base current supplied to the base of the bi-polar transistor Tr1 of a magnetic energy control means 6. As a result, a switching frequency of the first and second switching elements Q1, Q2 increases.

Therefore, the average current of the drain current and the resonance current reduces and becomes to the designated voltage. The other way, when the average current value is smaller than the reference voltage value, the comparator 12 increases the base current of the bi-polar transistor Tr1. As a result, the switching frequency of the first and second switching elements Q1, Q2 increases. Therefore, the average current of the drain current and the resonance current increases and becomes to the designated voltage.

Figure 4:
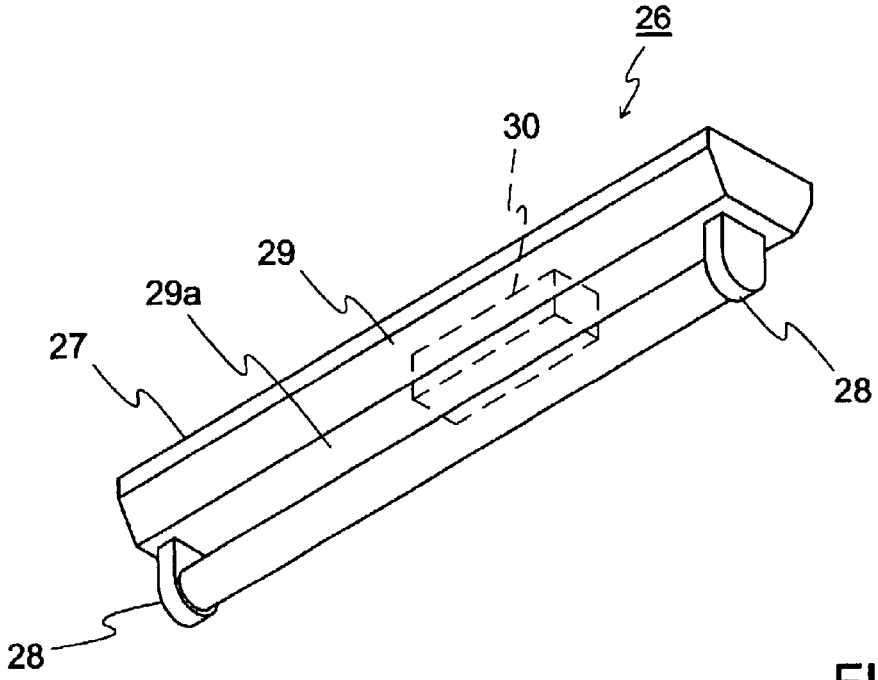
FIG. 4 is a lighting fixture using the electronic ballast according to a fourth embodiment of the present invention.
Figure 5:
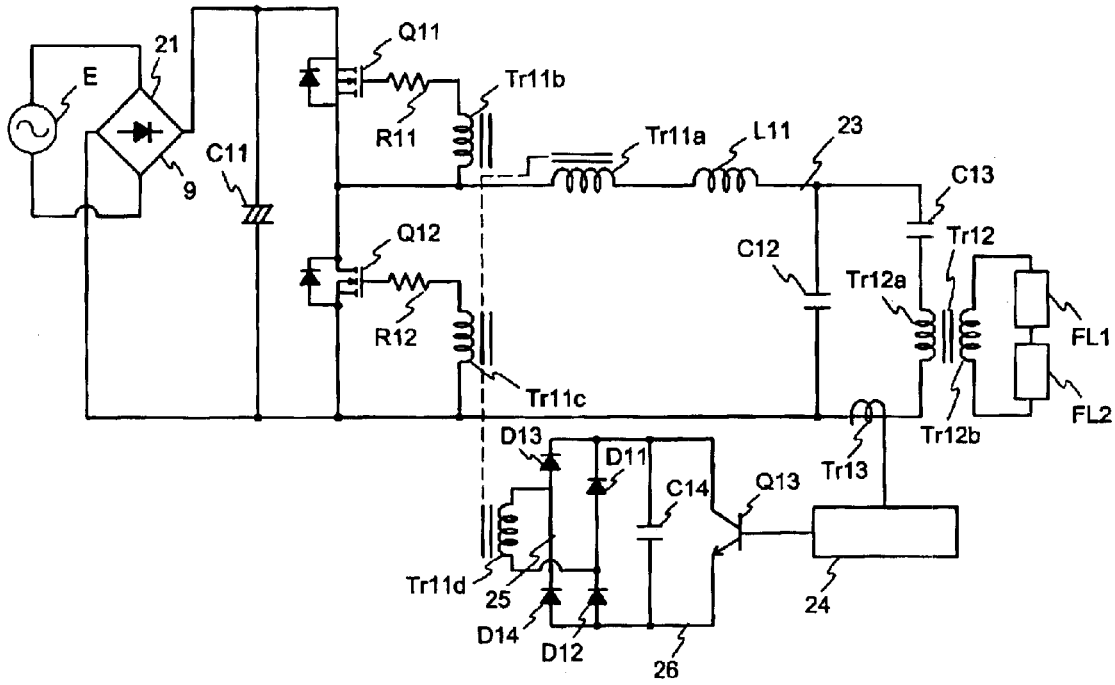
FIG. 5 is a circuit diagram of an electronic ballast according to a prior art.
Figure 6:
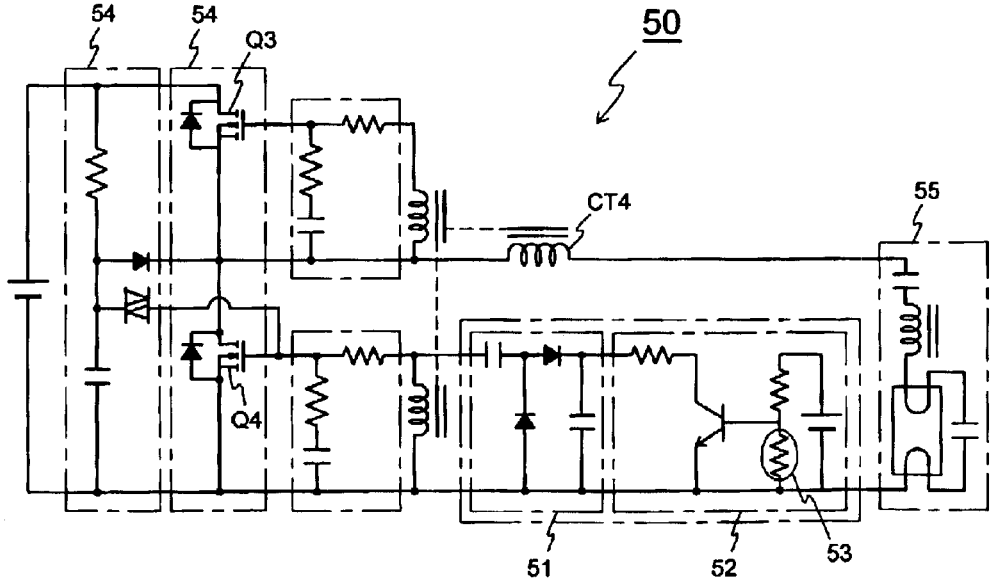
FIG. 6 is a circuit diagram of an electronic ballast according to a prior art.

A fourth embodiment of the present invention will be described in detail with reference to FIG. 4. FIG. 4 is a lighting fixture using the electronic ballast according to a sixth embodiment of the present invention.

The lighting fixture 26 is provided with a body 27, a reflector 29 having a reflecting surface 29*a*, and lamp sockets 28, arranged at opposite ends of the reflecting surface 3. Discharge lamp or a fluorescent lamp 10 is electrically and mechanically set between the lamp sockets 28. The fluorescent lamp 10 is lit by an electronic ballast 30 of the above embodiments, accommodated in the body 2.

Since the electronic ballast 30 controls the output voltage of the direct current power supply to fix to a designated voltage, a consumption of electricity of the road circuit fixes. Accordingly, even though characteristics of the current transformer CT1 in the lighting fixture 26 change caused by a temperature, the consumption of electricity of the road circuit 4 can fix. Therefore, the fluorescent lamp 10 can light stable.

What is claimed is:

1. An electronic ballast, comprising:

a direct current power supply configured to provide a direct current voltage;

a switching circuit, including first and second switching elements, connected in parallel with the direct current power supply, configured to convert the direct current voltage to a high-frequency alternating current;

a load circuit, including a discharge lamp, a resonance inductor, and a resonance capacitor, being operated by the high-frequency alternating current;

a driving circuit, arranged between the switching circuit and the load circuit, provided with feedback windings magnetically connected to a detecting winding of the current transformer, and configured to control a switching frequency of the first and second switching elements according to a detected current of the detecting winding;

a magnetic energy control means, configured to control a magnetic energy of the current transformer;

a current detecting means detecting an average current either an output current of the direct current power supply or a current of the switching circuit; and a current control means, configured to control the magnetic energy control means, and to fix the average current to a designated value.

2. An electronic ballast, comprising:

a direct current power supply configured to provide a fixed direct current voltage;

a switching circuit, including first and second switching elements, connected in parallel with the direct current power supply, configured to convert the direct current voltage to a high-frequency alternating current;

a load circuit, including a discharge lamp, a resonance inductor, and a resonance capacitor, being operated by the high-frequency alternating current;

a driving circuit, provided with a detecting winding of a current transformer, and configured to control a switching frequency of the first and second switching elements according to a detected current of the detecting winding;

a magnetic energy control means, including a base of a transistor, configured to control a magnetic energy of the current transformer;

a current detecting means detecting an average current either an output current of the direct current power supply or a current of the switching circuit; and a current control means, configured to control the magnetic energy control means and to fix the average current to a designated value, provided with a comparator, wherein the comparator compares a voltage signal of the average current with a reference voltage, and its output supplies to a base current of the base of the transistor.

3. A lighting fixture, comprising:

a body;

lamp sockets, constructed and arranged on the body; and an electronic ballast, comprising;

a direct current power supply configured to provide a direct current voltage;

a switching circuit, including first and second switching elements, connected in parallel with the direct current power supply, configured to convert the direct current voltage to a high-frequency alternating current;

a load circuit, including a discharge lamp, a resonance inductor, and a resonance capacitor, being operated by the high-frequency alternating current;

a driving circuit, arranged between the switching circuit and the load circuit, provided with feedback windings magnetically connected to a detecting winding of the current transformer, and configured to control a switching frequency of the first and second switching elements according to a detected current of the detecting winding;

a magnetic energy control means, configured to control a magnetic energy of the current transformer;

a current detecting means detecting an average current either an output current of the direct current power supply or a current of the switching circuit; and a current control means, configured to control the magnetic energy control means, and to fix the average current to a designated value.

* * * * *